United States Patent [19]

Arney

[11] Patent Number: 4,778,181

[45] Date of Patent: Oct. 18, 1988

[54] HAND TOOL FOR TRUCK DRIVERS AND POLICEMEN

[76] Inventor: James L. Arney, 2179 Prudence Dr., Beavercreek, Ohio 45431

[21] Appl. No.: 57,044

[22] Filed: Jun. 3, 1987

[51] Int. Cl.[4] ..... B25F 1/04

[52] U.S. Cl. ..... 273/84 R; 7/143; 294/26

[58] Field of Search ..... 273/84; 7/100, 143; 294/24, 26

[56] References Cited

U.S. PATENT DOCUMENTS

| | | | |
|---|---|---|---|
| 1,325,414 | 12/1919 | Rummer | 7/100 X |
| 1,338,576 | 4/1920 | Keys | 7/100 X |
| 1,417,725 | 5/1922 | Fullenwider | 7/143 |
| 3,085,824 | 4/1963 | Johnson | 294/26 X |
| 3,101,964 | 8/1963 | Reaser | 294/26 X |
| 3,251,621 | 5/1966 | Reznicek | 294/26 |
| 3,385,601 | 5/1968 | Black | 273/84 |
| 3,635,374 | 1/1972 | Anketell | 273/84 |
| 3,645,212 | 2/1972 | Dahlstrom | 294/26 X |
| 3,843,981 | 10/1974 | Verest | 294/24 |
| 4,037,554 | 7/1977 | Foscolo | 294/24 X |
| 4,050,107 | 9/1977 | Parma | 294/24 |
| 4,351,126 | 9/1982 | Simonson | 294/26 X |

*Primary Examiner*—Carlton R. Croyle
*Assistant Examiner*—Theodore Olds
*Attorney, Agent, or Firm*—Jacox & Meckstroth

[57] ABSTRACT

An elongated generally cylindrical body of rigid plastics material has a handle portion and an outer portion and defines a longitudinally extending internal bore or chamber. An elongated rod is supported within the chamber for longitudinal movement and has an outer end portion projecting into an enlarged portion of the chamber. In one embodiment, a fifth wheel release actuator is removably connected to the outer end portion of the rod, and the rod supports the actuator for movement between a retracted position within the chamber and an extended position projecting outwardly from the body where the inner end portion of the rod threadably connects with the body. The actuater includes a pivotal hook-like plate which may be repositioned to provide for pushing or pulling of the fifth wheel release handle. In a modification, the chamber confines a pressurized tear gas canister or container which is shifted axially for dispensing the gas in response to axial movement of the rod within the chamber.

10 Claims, 1 Drawing Sheet

3
10
12
13
18
19
16
19
3

47
61
46
40
57
58
43
57
42
47
52
53
46
13
34
18
12

31
46
49
40
57
23
57
46
27
19
12
16
19
36
29
61
18
58
49
52
53
26
34
22
37

46
61
56
57
40
52
53
29
18
27
26
12
46
34
58
37
22

6
6
31'
73
72
23'
68
12'
84
82
10'
16'
22'
66
76
78
70
81
64

82
12'
84

82'
84'
92
12"
10"
16"
72'
73'
87
88
70'

HAND TOOL FOR TRUCK DRIVERS AND POLICEMEN

BACKGROUND OF THE INVENTION

In the construction of billy clubs commonly carried by law enforcement personnel, it is sometimes desirable to use the club for carrying a canister of tear gas which may be used in controlling a riot or other disturbance. It has also been determined that another form of billy club may be used by the driver of a truck or tractor and semi-trailer for checking the inflation of the tires on the truck and trailer. By bouncing a properly weighted club off of each tire, the driver can quickly determiner whether or not the air pressure within the tire is lower than desired. It has also been found desirable to adapt the billy club carried by a truck driver so that the club may be used for releasing the fifth wheel connection between the tractor and semi-trailer. While there have been various forms of billy clubs either constructed or proposed, none of the clubs provide all of the features and advantages mentioned above.

SUMMARY OF THE INVENTION

The present invention is directed to an improved billy club which is ideally suited for use by either the driver of a semi-truck and trailer rig or by law enforcement personnel and which provides all of the desirable features mentioned above. In accordance with one embodiment of the invention, an elongated generally cylindrical body of rigid plastics material is molded in two mating half sections which are cemented together and cooperate to define an internal axially extending bore or chamber. A metal rod is supported within the chamber for axial movement, an outer end portion of the rod supports a fifth wheel release actuator which is movable with the rod between a retracted position within the chamber and an extended position where a hook-like element or plate pivots outwardly for engaging the fifth wheel release handle. In this position, the inner end portion of the support rod is threadably connected to the club body so that the support rod does not retract when actuating the fifth wheel release handle.

In a modification of the billy club, a removable gas canister is confined within either the outer end portion or the handle portion of the billy club and is retained within the chamber by a closure plug threadably connected to the end of the club. An actuating rod within the chamber is shifted axially to move the gas canister when it is desired to release gas through a passage within the center of the closure member.

Other features and advantages of the invention will be apparent from the following description, the accompanying drawing and the appended claims.

DESCRIPTION OF THE PREFERRED EMBODIMENTS

Figure 1:
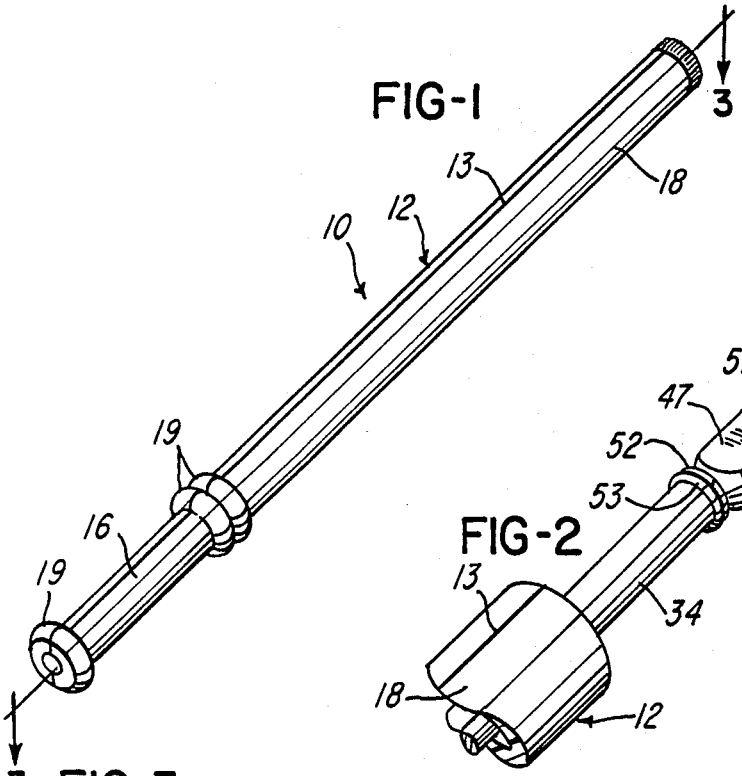
FIG. 1 is the perspective view of a billy club constructed in accordance with the invention.

FIG. 1 illustrates a billy club 10 which includes an elongated generally cylindrical body 12 molded of a rigid plastics material. Preferably, the body 12 is molded in two mating half sections, and the sections are joined together with a suitable cement applied to the abutting surfaces which form the connecting joint 13. The body 12 includes a handle portion 16 and an outer end portion 18, and outwardly projecting circumferential ribs 19 are located at opposites ends of the handle portion 16.

The body 12 has a longitudinally extending cylindrical bore or chamber 22 which extends to a slightly larger cylindrical chamber 23 within the outer end portion 18 of the body 12. An internally threaded sleeve or collar 26 is located within the outer end portion of the chamber 22 and is confined within a cylindrical cavity 27 before the half sections of the body 12 are cemented together. The outer tip portion of the body 12 is provided with internal threads 29 for receiving a closure member or plug 31 which is also preferably molded of a rigid plastics material.

An elongated metal rod 34 extends axially within the chamber 22 and through the collar 26. The inner end portion of the rod 34 has an enlarged cylindrical portion 36 which slides axially within the bore 22, and a threaded portion 37 is formed on the rod 34 in front of the cylindrical portion 36. A fifth wheel actuator 40 includes a body or housing 42 which has a cylindrical intermediate portion 43 integrally connecting opposite end portions 46 each having a pair of opposite flat surfaces 47. Each end portion 46 has an internally threaded bore or hole 49, and the outer end portion of the rod 34 is threaded into the hole 49 within the inner end portion 46. The actuator housing 42 is rigidly secured to the outer end portion of the rod 34 and is locked by a lock washer 52 located adjacent a resilient O-ring 53.

Figure 2:
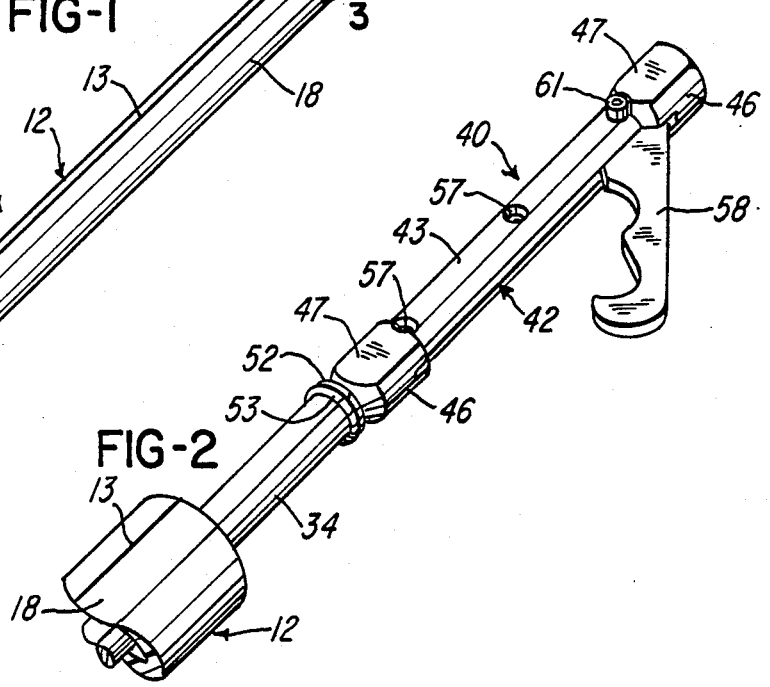
FIG. 2 is an enlarged fragmentary perspective view of the billy club shown in FIG. 1 and with the fifth wheel release actuator partially extended.

The actuator housing 42 has a longitudinally extending slot 56 within the intermediate portion 43, and the slot 56 is interrupted by three axially spaced threaded holes 57. A hook-shaped actuating plate or finger 58 is disposed within the slot 56 and is supported for pivotal movement by a screw 61 which is threaded into one of the holes 57. The actuating finger 58 is pivotable between a retracted position (FIG. 3) and an outwardly projecting position (FIGS. 2 and 4) with respect to the actuator housing 42. The finger 58 may be located in one of four different positions by inserting the pivot screw 61 into one of the other holes 57 and by reversing the position of the finger 58.

When the support rod 34 and actuator 40 are retracted (FIG. 3) and retained by the closure plug 31, the billy club 10 is ideally suited for use in testing the degree of inflation of a pneumatic truck tire by beating the tire with the club 10. The extra weight within the outer end portion 18 of the billy club 10, as provided by the metal rod 34 and metal actuator 40, is effective to deform the pneumatic tire so that the truck driver or person swinging the club 10 is able to sense whether or not the tire is underinflated.

Figure 3:
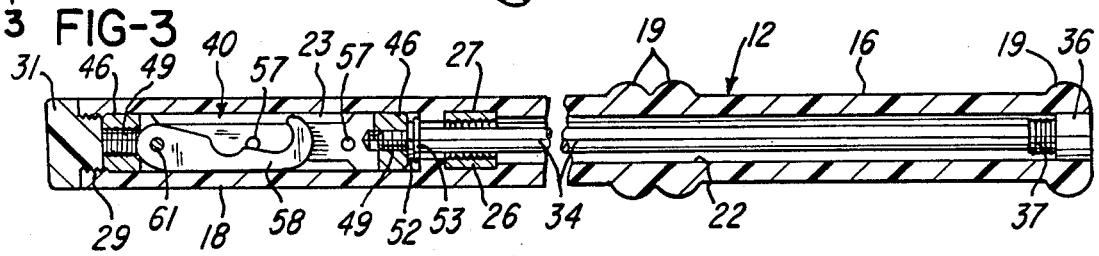
FIG. 3 is an axial section of the billy club, as taken generally on the line 3—3 of FIG. 1.
Figure 4:
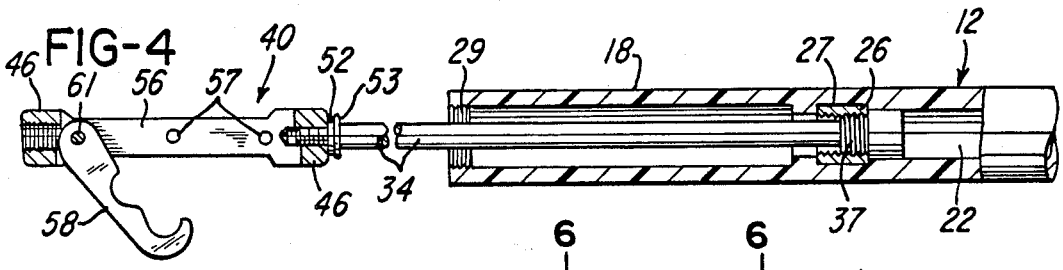
FIG. 4 is a fragmentary section similar to FIG. 3 and showing the fifth wheel release actuator fully extended.

When it is desired to release the fifth wheel on a tractor for removing a semi-trailer, the closure plug 31 is unthreaded and removed, and the actuator 40 and its support rod 34 are extended to a position where the threaded portion 37 is threaded into the collar 26, as shown in FIG. 4. The hook member or finger 58 is then used to engage the safety latch and release handle for the fifth wheel and to move or shift the handle in a direction which releases the semi-trailer from the fifth wheel on the tractor. After the fifth wheel is released, the actuator 40 and support rod 34 are returned to their retracted positions, as shown in FIG. 3, where they are retained again by the closure plug 31. By repositioning the finger 58 within the slot 56, the finger 58 may be used for either pushing a fifth wheel release handle or pulling the handle, as may be required according to the different forms of fifth wheels used on tractors.

Figure 5:
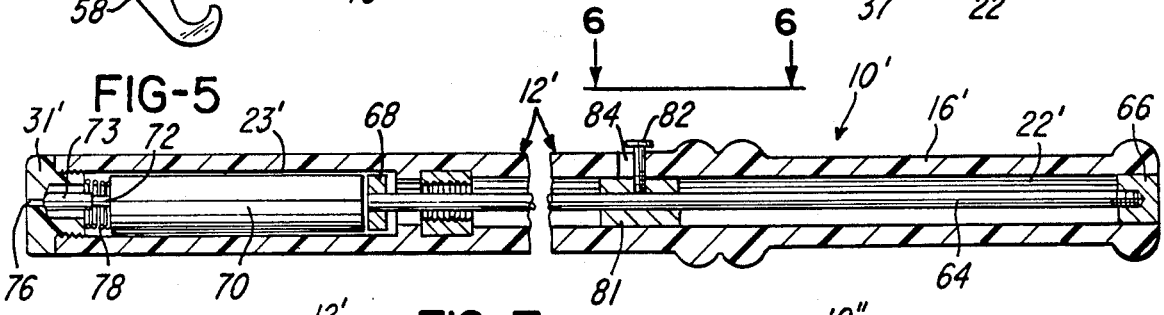
FIG. 5 is an axial section similar to FIG. 3 and showing a modification of the billy club.
Figure 6:
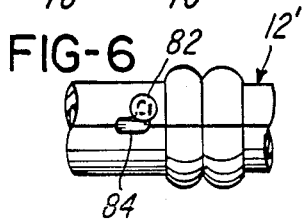
FIG. 6 is a fragmentary view taken generally on the line 6—6 of FIG. 5.

Referring to FIGS. 5 and 6, a billy club 10' is ideally suited for use by law enforcement personnel and includes a body 12' constructed as described above. In place of the rod 34 and fifth wheel actuator 40, the billy club body 12' confines or encloses an actuator rod 64 which extends axially or longitudinally of the chamber 22'. The rearward or inner end portion of the rod 64 is threaded into a cylindrical bushing 66, and the forward or outer end portion of the rod 64 receives a collar 68 which is located within the chamber 23'. A container or canister 70 encloses a pressurized gas such as a tear gas and is located within the chamber 23'. The canister 70 has a tubular dispensing valve stem 72 which receives an enlarged tubular nozzle 73. A hole or passage within the nozzle 73 aligns with a center hole 76 within a closure plug 31'. A compression spring 78 extends between the inner end of the closure plug 31' and the forward end of the canister 70 to assure that the canister is normally retracted within the chamber 23' and the dispensing valve stem 72 is in its normally closed position.

A cylindrical sleeve 81 is mounted on the rod 64 directly in front of the handle portion 16' of the body 12' and is secured to the rod 64 by a thumb screw 82 which projects radially inwardly through a bayonet-type slot 84 (FIG. 6) formed within the body 12'. When a person desires to dispense a charge of tear gas from the container 70 through the outlet or opening 76, the person gripping the handle portion 16' merely shifts the thumb screw 82 forwardly within the slot 84. As the collar 68 moves forwardly with the rod 64, the collar moves the canister 70 forwardly relative to the valve stem 72 and against the compression spring 78 to dispense the pressurized gas through the nozzle 73 and the outlet passage 76. When the thumb screw 82 is released, the spring 78 returns the canister 70 and the actuator rod 64 to their normally retracted or off positions, as shown in FIG. 5. The rod 64 may also be activated by depressing the button 66.

Figure 7:
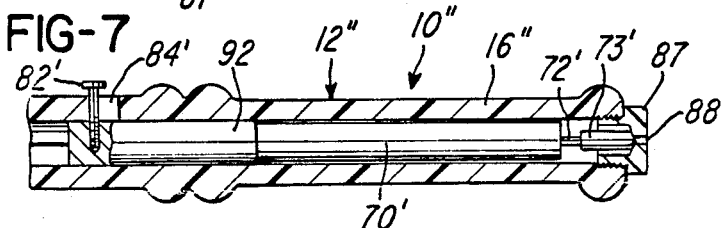
FIG. 7 is a fragmentary section of the handle portion of a billy club constructed in accordance with another modification of the invention.

Referring to FIG. 7, it is also within the scope of the invention to construct a billy club 10● wherein the handle portion 16'' of the body 12'' confines a container or canister 70' of a gas such as tear gas. In this embodiment, the valve stem 72' and nozzle 73' project towards a closure plug 87 threaded into the inner end of the handle portion 16''. The closure plug 87 has a center discharge opening or passage 88 which aligns with the tubular nozzle 73', and gas is dispensed or released through the passage 88 by shifting the canister 70' rearwardly or towards the inner end of the body 12''. This movement or shifting of the canister 70' is produced by shifting an actuator plug or rod 92 by means of a thumb screw 82' extending through a slot 84'. The modification shown in FIG. 7 permits the tear gas canister 70' to be confined within the handle portion of the billy club instead of the outer end portion in the event the user of the billy club prefers to dispense the gas from the handle portion of the club.

While the forms of billy clubs herein described constitute preferred embodiments of the invention, it is to be understood that the invention is not limited to these precise forms, and that changes may be made therein without departing from the scope and spirit of the invention as defined in the appended claims.

The invention having thus been described, the following is claimed:

1. A billy club adapted to be carried in a truck for testing the inflation of the truck tires and for releasing a fifth wheel, comprising an elongated rigid body having a handle portion and an outer end portion and defining a longitudinally extending internal chamber, an elongated rod disposed within said chamber for longitudinal axial movement between a retracted position within said chamber and an extended position projecting outwardly from said chamber, said rod having an inner end portion and an outer end portion, a fifth wheel release actuator mounted on said outer end portion of said rod, said release actuator including an actuator housing and a finger member, means on said actuator housing and supporting said finger member for pivotal movement between a retracted position adjacent said actuator housing and an outwardly projecting position adapted to engage a fifth wheel release handle, said actuator housing and said finger member in said retracted position being confined within said chamber in said outer end portion of said body when said rod is in said retracted position, said actuator housing and said finger member being disposed in an extended position from said body when said rod is in said extended position, and means for releasably retaining said rod and said release actuator within said chamber.

2. A billy club as defined in claim 1 wherein said actuator housing is elongated and defines a longitudinally extending slot, and said finger member comprises a finger plate disposed within said slot.

3. A billy club as defined in claim 1 wherein said means supporting said finger member comprise a removable pivot pin, and said finger member is connectable to said actuator body by said pivot pin in different positions.

4. A billy club as defined in claim 1 wherein said finger member has a recess forming a hook-shaped end portion.

5. A billy club as defined in claim 1 wherein said actuator housing is threadably connected to said outer end portion of said rod and is removable therefrom.

6. A billy club as defined in claim 1 wherein said chamber has an enlarged end portion for receiving said actuator housing.

7. A billy club as defined in claim 1 wherein said body comprises a pair of mating body sections each defining a portion of said chamber, and means for securing said body sections together.

8. A billy club as defined in claim 1 wherein said means for retaining said rod and said release actuator within said chamber, comprise an end closure plug threadably connected to said body.

9. A billy club adapted to be carried in a truck for testing the inflation of the truck tires and for releasing a fifth wheel, comprising an elongated rigid body having a handle portion and an outer end portion and defining a longitudinally extending internal chamber, an elongated rod disposed within said chamber for longitudinal movement between a retracted position within said chamber and an extended position projecting outwardly from said chamber, said rod having an inner end portion and an outer end portion, a fifth wheel release actuator mounted on said outer end portion of said rod, said release actuator including an actuator housing and a finger member, means on said actuator housing and supporting said finger member for pivotal movement between a retracted position adjacent said actuator housing and an outwardly projecting position adapted to engage a fifth wheel release handle, said actuator housing and said finger member in said retracted position being confined within said chamber in said outer end portion of said body when said rod is in said retracted position, said actuator housing and said finger member being disposed in an extended position from said body when said rod is in said extended position, means for releasably connecting said inner end portion of said rod to said outer end portion of said body when said rod is in said extended position, and means for retaining said rod and said release actuator within said chamber.

10. A billy club as defined in claim 1 wherein said means connecting said inner end portion of said rod to said body, comprise external threads on said inner end portion of said rod, and means defining internal threads within said chamber for releasably engaging said external threads.

* * * * *